US008615934B1

(12) United States Patent
Webb et al.

(10) Patent No.: US 8,615,934 B1
(45) Date of Patent: Dec. 31, 2013

(54) PANELIZED PORTABLE SHELTER

(76) Inventors: Stephen C. Webb, Wasilla, AK (US); Terry J. Webb, Wasilla, AK (US); Orrin K. Gerke, La Center, WA (US); Cathrine E. Henderson, La Center, WA (US)

( * ) Notice: Subject to any disclaimer, the term of this patent is extended or adjusted under 35 U.S.C. 154(b) by 0 days.

(21) Appl. No.: 13/317,048

(22) Filed: Oct. 7, 2011

(51) Int. Cl.
*E04H 1/00* (2006.01)

(52) U.S. Cl.
USPC ..... 52/79.9; 52/86; 52/299

(58) Field of Classification Search
USPC ..... 52/79.9, 79.5, 79.6, 86, 87, 79.4, 80.1, 52/81.2, 299, 79.1
See application file for complete search history.

(56) References Cited

U.S. PATENT DOCUMENTS

| | | | | | |
|---|---|---|---|---|---|
| 1,377,500 | A | * | 5/1921 | Nissen | 52/86 |
| 2,169,474 | A | * | 8/1939 | Pederson | 52/86 |
| 2,287,229 | A | * | 6/1942 | Carpenter | 52/79.9 |
| 2,328,197 | A | * | 8/1943 | Cowin | 52/86 |
| 2,358,388 | A | * | 9/1944 | Everitt | 52/82 |
| 2,363,917 | A | * | 11/1944 | Waterman et al. | 135/116 |
| 2,407,252 | A | * | 9/1946 | Closs | 52/86 |
| 2,480,642 | A | * | 8/1949 | Galloway | 52/86 |
| 2,482,918 | A | * | 9/1949 | Kump, Jr. | 52/64 |
| 2,691,291 | A | * | 10/1954 | Henderson | 52/79.9 |
| 2,706,313 | A | * | 4/1955 | Radman | 52/79.9 |
| 2,751,635 | A | * | 6/1956 | Donnahue | 52/69 |
| 2,806,477 | A | * | 9/1957 | Fritsche | 135/132 |
| 2,827,138 | A | * | 3/1958 | Roy, Jr. | 52/86 |
| 2,874,812 | A | * | 2/1959 | Clevett, Jr. | 52/223.7 |
| 3,088,558 | A | * | 5/1963 | Dickinson | 52/23 |
| 3,156,018 | A | * | 11/1964 | Slayter | 52/73 |
| 3,226,907 | A | * | 1/1966 | Gregoire | 14/74.5 |
| 3,361,144 | A | * | 1/1968 | Folkes | 135/129 |
| 3,415,260 | A | * | 12/1968 | Hall | 135/129 |
| 3,464,168 | A | * | 9/1969 | Lyons, Jr. et al. | 52/63 |
| 3,713,620 | A | * | 1/1973 | Tkach | 248/678 |
| 3,780,477 | A | * | 12/1973 | Sprung, Jr. | 135/124 |
| 3,902,288 | A | * | 9/1975 | Knudson | 52/86 |
| 3,932,969 | A | * | 1/1976 | Matras | 52/86 |
| 3,961,442 | A | * | 6/1976 | Carter | 52/86 |
| 4,000,850 | A | * | 1/1977 | Diggs | 126/613 |
| 4,028,854 | A | * | 6/1977 | Diggs | 52/93.1 |
| 4,118,904 | A | * | 10/1978 | Sprung | 52/63 |
| 4,137,687 | A | * | 2/1979 | Sprung | 52/745.07 |
| 4,194,328 | A | * | 3/1980 | Peirson et al. | 52/86 |
| 4,425,742 | A | * | 1/1984 | Markey et al. | 52/92.2 |
| RE31,565 | E | * | 4/1984 | Beaulieu | 135/145 |
| 4,590,721 | A | * | 5/1986 | Berg et al. | 52/169.1 |
| 4,593,710 | A | * | 6/1986 | Stafford et al. | 135/136 |
| 4,616,452 | A | * | 10/1986 | Lemerre | 52/71 |

(Continued)

*Primary Examiner* — William Gilbert
*Assistant Examiner* — James Ference
(74) *Attorney, Agent, or Firm* — Michael J. Tavella

(57) ABSTRACT

A modular, panelized 12-foot wide shelter that has a standard 20-foot length. The shelter has a number of premade frame panels that are assembled over a deck floor. An outer covering of hard, 0.040" black ABS sheeting, which can be painted, is applied to the frame. The walls, roof arches, and end panels can be insulated to reduce or eliminate condensation. The floor is insulated as a standard feature. Each wall/roof section has one 5,000 pound rated galvanized anchor ring attached for tie-downs in windy locations, if needed. Because the entire shelter fits on a single pallet, it can be transported to remote sites by various methods—trucks, barges, helicopters, or snowmobiles. The shelter can be assembled by two workers in less than a day using simple tools. The structure is designed to be transported by truck, helicopter or snowmobile.

12 Claims, 14 Drawing Sheets

(56) References Cited

U.S. PATENT DOCUMENTS

| | | | | | |
|---|---|---|---|---|---|
| 4,653,238 | A * | 3/1987 | Berman | 52/79.4 |
| 4,672,779 | A * | 6/1987 | Boyd | 52/79.4 |
| 5,036,634 | A * | 8/1991 | Lessard et al. | 52/79.1 |
| 5,245,802 | A * | 9/1993 | Davis | 52/86 |
| 5,293,725 | A * | 3/1994 | Matticks et al. | 52/271 |
| 5,313,756 | A * | 5/1994 | Ways et al. | 52/263 |
| 5,323,573 | A * | 6/1994 | Bakewell, III | 52/86 |
| 5,333,421 | A * | 8/1994 | McKenna | 52/86 |
| 5,361,554 | A * | 11/1994 | Bryan | 52/480 |
| 5,493,818 | A * | 2/1996 | Wilson | 52/71 |
| 5,505,031 | A * | 4/1996 | Heydon | 52/281 |
| 5,566,514 | A * | 10/1996 | Freller | 52/79.5 |
| 5,611,178 | A * | 3/1997 | Aubert | 52/169.6 |
| 5,623,803 | A * | 4/1997 | Willis | 52/650.3 |
| 5,651,220 | A * | 7/1997 | dit Felix | 52/81.5 |
| 5,822,930 | A * | 10/1998 | Klein | 52/143 |
| 6,141,902 | A * | 11/2000 | Boice | 47/17 |
| 6,176,055 | B1 * | 1/2001 | Fu | 52/292 |
| 6,301,854 | B1 * | 10/2001 | Daudet et al. | 52/650.1 |
| 6,308,486 | B1 * | 10/2001 | Medland | 52/506.05 |
| 6,324,801 | B1 * | 12/2001 | Holfman et al. | 52/299 |
| 6,418,694 | B1 * | 7/2002 | Daudet et al. | 52/650.1 |
| 6,434,891 | B1 * | 8/2002 | Cameron | 52/86 |
| 6,578,331 | B1 * | 6/2003 | Leslie et al. | 52/265 |
| 6,581,337 | B1 * | 6/2003 | Skov et al. | 52/79.5 |
| 6,645,032 | B2 * | 11/2003 | Barringer et al. | 446/108 |
| 6,679,009 | B2 * | 1/2004 | Hotes | 52/86 |
| 6,691,478 | B2 * | 2/2004 | Daudet et al. | 52/289 |
| 6,761,005 | B1 * | 7/2004 | Daudet et al. | 52/272 |
| 6,851,234 | B2 * | 2/2005 | Hoffman et al. | 52/299 |
| 7,086,209 | B1 * | 8/2006 | Pruitt et al. | 52/745.13 |
| 7,240,459 | B2 * | 7/2007 | Daudet et al. | 52/289 |
| 7,849,639 | B2 * | 12/2010 | Sprung | 52/82 |
| 2001/0032428 | A1 * | 10/2001 | Hoffman et al. | 52/299 |
| 2002/0017069 | A1 * | 2/2002 | Hoffman et al. | 52/299 |
| 2002/0108646 | A1 * | 8/2002 | Hotes | 135/124 |
| 2003/0072920 | A1 * | 4/2003 | Klinger | 428/188 |
| 2004/0074158 | A1 * | 4/2004 | De Zen | 52/79.9 |
| 2004/0163335 | A1 * | 8/2004 | Hampel | 52/143 |
| 2006/0080905 | A1 * | 4/2006 | Morello | 52/86 |
| 2007/0175138 | A1 * | 8/2007 | Jensen | 52/299 |
| 2008/0005975 | A1 * | 1/2008 | Thompson | 52/62 |
| 2009/0013615 | A1 * | 1/2009 | Kitagawa | 52/79.12 |
| 2009/0217617 | A1 * | 9/2009 | Kennedy et al. | 52/781 |
| 2010/0064601 | A1 * | 3/2010 | Napier | 52/79.5 |

* cited by examiner

PANELIZED PORTABLE SHELTER

CROSS REFERENCE TO RELATED APPLICATIONS

Not Applicable

STATEMENT REGARDING FEDERALLY SPONSORED RESEARCH AND DEVELOPMENT

Not Applicable

BACKGROUND OF THE INVENTION

1. Field of the Invention

This invention relates to portable shelters and particularly to portable shelters made of panels.

2. Description of the Prior Art

Portable shelters and buildings have been used since the beginning of human history. One of the oldest is the tent. Tents, however, have many problems. They are not comfortable due to the wind and dust entering the tents. Tents are also prone to damage from animals such as bears and from theft from passers-by. Tents also tend to suffer from condensation problems with water forming on the inside of the tent. Tents are not designed for heavy snow loads and consequently must be struck and packed away each winter. Finally, tents are prone to leaking in rain.

Over the years people have developed other types of portable shelters that use hard sided-walls. Some of these shelters can be used as permanent remote camps. Some examples of these shelters are found in the following U.S. patents. U.S. Pat. No. 2,407,252 teaches a prefabricated building that uses arch type frame members. However, the construction and assembly is complex and is not designed for simple, fast erection in remote areas. U.S. Pat. No. 3,780,477 is a demountable building that uses arched members to support a fabric cover. Although this shelter has a frame structure, the fabric walls make it a little better than a tent. U.S. Pat. No. 4,118,904 teaches another frame structure that is covered with a stressed membrane cover. The shelter uses a large number of metal arch type members that are erected and covered with fabric. This structure, again, is a supported tent. Moreover, the design makes it complex to assemble, requiring time and workers. This structure is not something ideal for remote sites. U.S. Pat. No. 4,194,328 teaches a large cabin type structure that has arch type framing. This structure however is not really designed for portability or remote locations. U.S. Patent Application No. US 2002/0108646 teaches a compact-all weather shelter. Although the unit is portable, it has a complex frame, is covered by fabric walls and has end gables that are fitted with doors. Such a system is large and not designed as a one or two person system. U.S. Patent Application No. US2009/0217617 teaches a shelter using panel type wall construction. Again, although portable, this shelter uses a complex frame structure that requires delivery in multiple loads and a crew of workers to assemble.

Although there are many examples of portable shelters, most of them either use fabric covers or have complex frame structures that require large crews to assemble. Many are portable, but require large trucks to carry the components-making installation in remote, off road locations almost impossible. Thus, a shelter that can be easily transported in one load by a helicopter is needed. This shelter must be assembled quickly, by no more than two people. Finally, the shelter must have integrity to withstand harsh winter conditions and must be designed for permanent occupation.

BRIEF DESCRIPTION OF THE INVENTION

The instant invention overcomes all of the problems and meets the criteria for a portable shelter, as described above. The shelter is a modular, panelized 12-foot wide shelter that has a standard 20-foot length. The shelter has been designed to support snow depths of 60" (although with the slope of the building it would be impossible for more than 30" to accumulate).

The shelter has an outer covering of hard, 0.040" black ABS sheeting that can be painted. The ABS sheeting is applied with 3M VHB bonding tape, so no fasteners are exposed. The 3M VHB tape produces a permanent bond. The ABS sheeting can be field repaired, if needed, with acetone or ABS glue and replacement ABS sheeting pieces. The walls, roof arches, and end panels can be insulated to reduce or eliminate condensation. The floor is insulated as a standard feature. Each wall/roof section has one 5,000 pound rated galvanized anchor ring attached for tie-downs in windy locations, if needed.

The shelter has a foam insulated 3'0"×6'8" entry door with deadbolt and three 3'2'×'0" single-hung vinyl egress windows. The shelter is shipped on a single pallet that converts into a 6'×12' front deck. The front deck also doubles as a sun-porch.

Because the entire shelter fits on a single pallet, it can be transported to remote sites by various methods—trucks, barges, helicopters, or snowmobiles.

The shelter can be assembled by two workers in less than a day. The only tools needed are: a 6' step ladder, two 6'-12' extendable paint poles, a level, two large Phillips screwdrivers, one ⅜" ratchet and ½" socket, one ½" end wrench, one shovel, one pick and a cordless screwdriver/drill.

If the structure is transported to a remote location by helicopter, the assembly can be done as follows: the first flight takes the two workers, tools and all components from the deck down (foam pier pads, floor panel support planks and floor panels as well as the transportation pallet/front deck. While the helicopter makes the return flight the two workers can level the site for the foam pier blocks and install the floor panel support planks (and possibly the floor panels). When the helicopter returns with the end wall and wall/roof panels (which are held together with 1" ratchet straps) the workers have everything they need to complete the shelter by the end of the day.

If the shelter is transported to a remote site by snowmobile, the individual panels can be placed on a sled and hauled to the site piecemeal as no panel is over 120 pounds.

If the shelter is delivered to a road accessible site by truck only a forklift is needed to remove the package from the truck deck and place it close to the building site. No other heavy equipment is required.

DETAILED DESCRIPTION OF THE INVENTION

Figure 1:
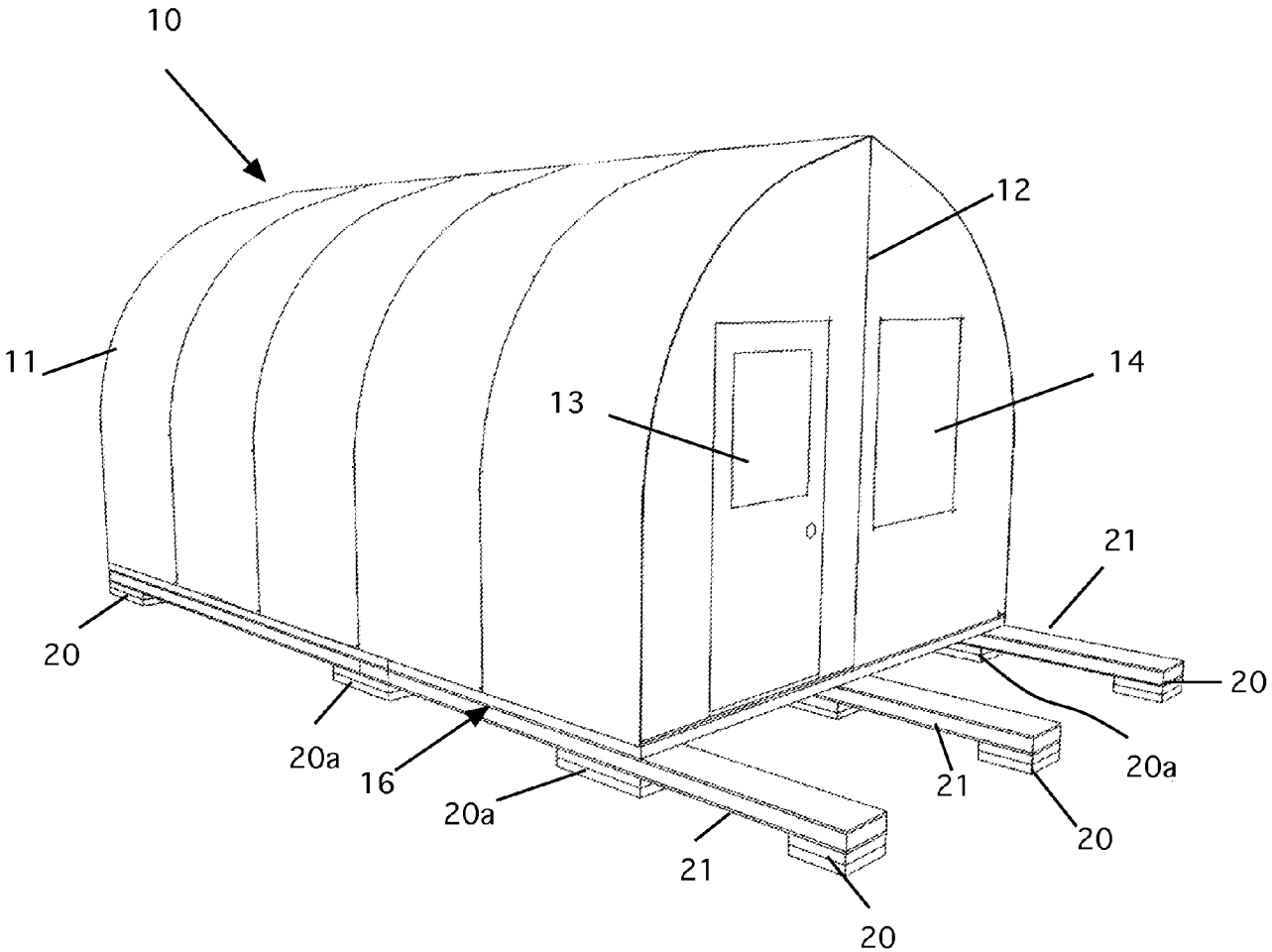
FIG. 1 is a front perspective view of the assembled invention.

Referring now to FIG. 1, a front perspective view of the assembled invention is shown. The invention 10 is a but made of preformed wall panels 11, end panels 12, which includes a door 13 and a window 14, a floor 15 (see FIG. 5), and a foundation 16. As noted above, the shelter is 12 feet by 20 feet long.

Figure 2:
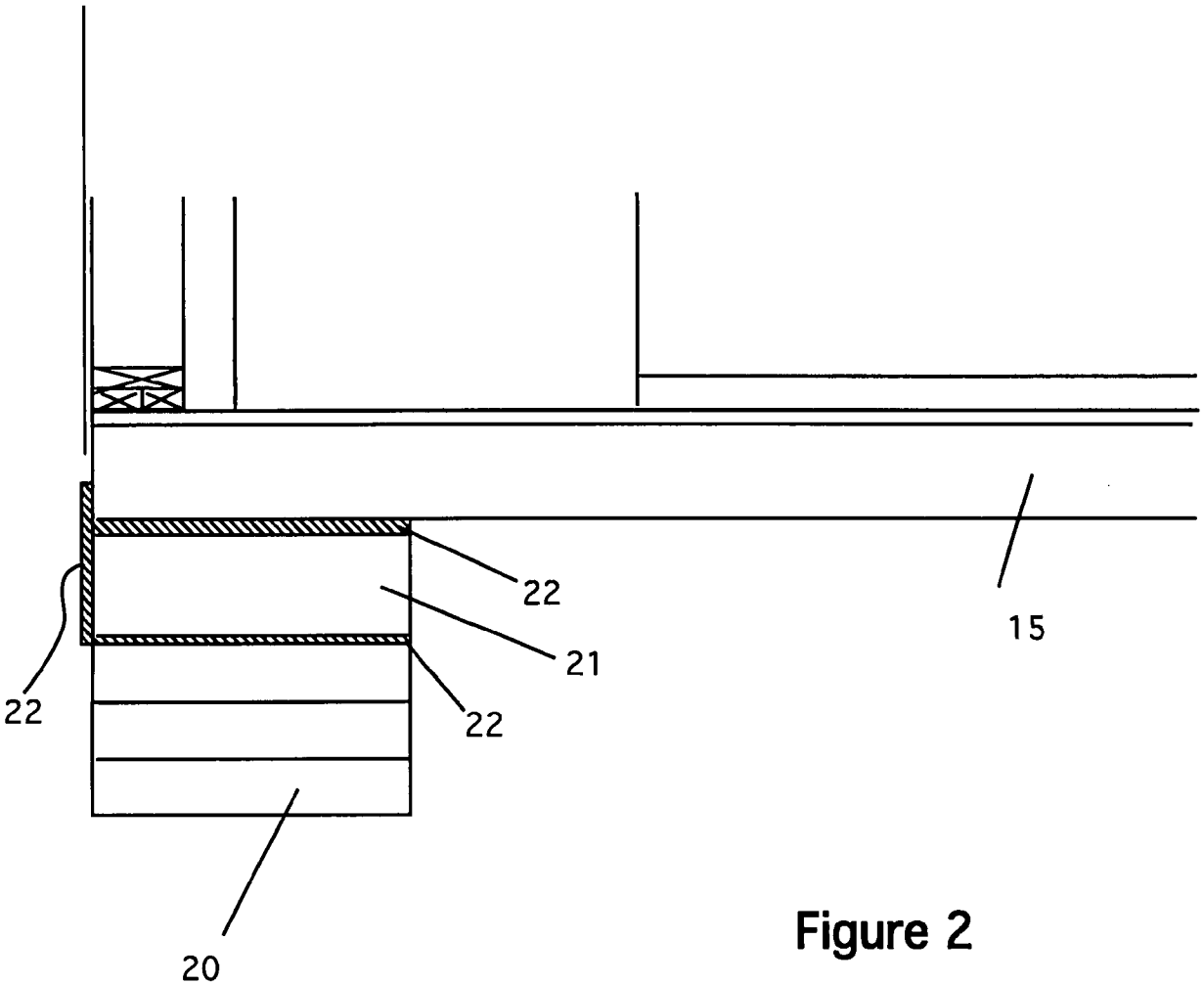
FIG. 2 is a detail of the foundation members.

Beginning at the bottom of the unit, FIG. 2 is a detail of the foundation, which is also shown in FIG. 1. The foundation 16 is made up of a set of base pads 20 and 20*a* that are foam pier pads made of high-density foam—40 pounds per square inch. There are 3, 2'×1' pads 20 at building ends and support plank junctions and 3, 1'×1' pads 20*a* at centers of the support planks and at the front edge of the front deck (not shown). There will be a minimum of 6" of pads supplied at each point. At each pier pad location there will be one pad that has been hot wire cut on a diagonal to allow height adjustment. The worker only has to clear vegetation and level the subsoil prior to placement of the foam pier pads. A level is then used to match the elevations of all pads. Above the foam pads are support planks 21, which are 1'×12'×4⅛" thick and weigh less than 50 pounds per plank. Note that for each foundation beam, two planks are used. This produces a four-foot extension (see FIG. 1) on to which a deck can be built (see below). As shown in FIG. 2, the planks are preferably made of metal studs and tracks. Each of the planks has a ⅜" plywood layer 22 on the top, bottom and outside (on building sides. These planks are placed on the foam pier pads. Note, FIG. 1 shows two planks forming each of the foundation beams.

Figure 3:
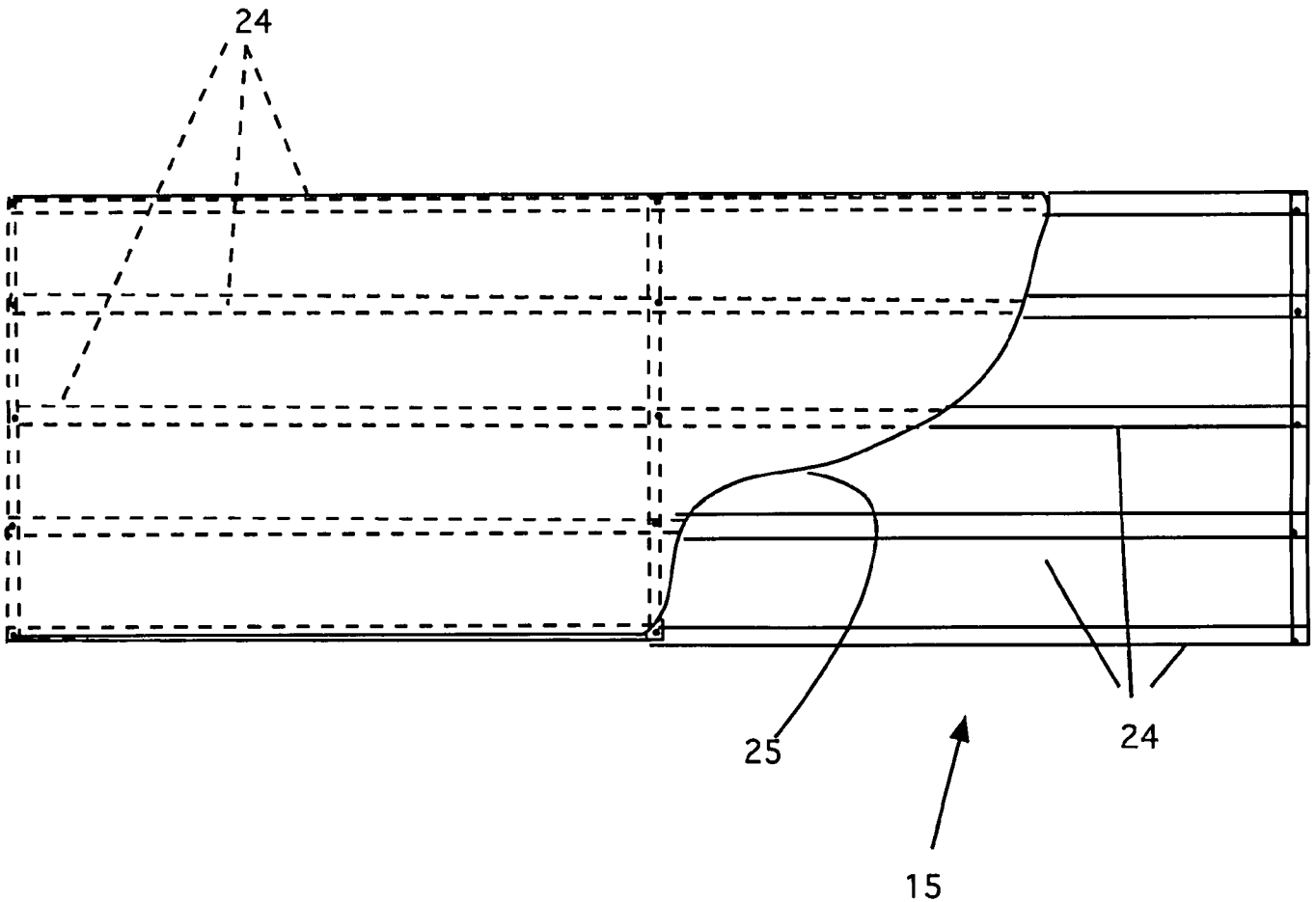
FIG. 3 is a detail of the floor frame.

Above this foundation is the floor 15. FIG. 3 is a detail of the floor frame. The floor panels are made of structural grade metal framing 24, which is covered by a ⅜" thick fir plywood flooring 25 that is fastened with urethane glue and screws. In the preferred embodiment, the plywood is painted with a 30-year warranty latex paint.

Each floor panel also has 1" to 1½" urethane foam sprayed on the underside for insulation. Each floor panel is twelve feet long by four feet wide and weighs less than 120 pounds so two workers can easily maneuver them into place atop the support planks. Thus, five of the panels are needed for a typical 12'×20' shelter. Once the panels are in place they are fastened together and down to the foundation using screws to form a solid floor assembly.

Figure 4:
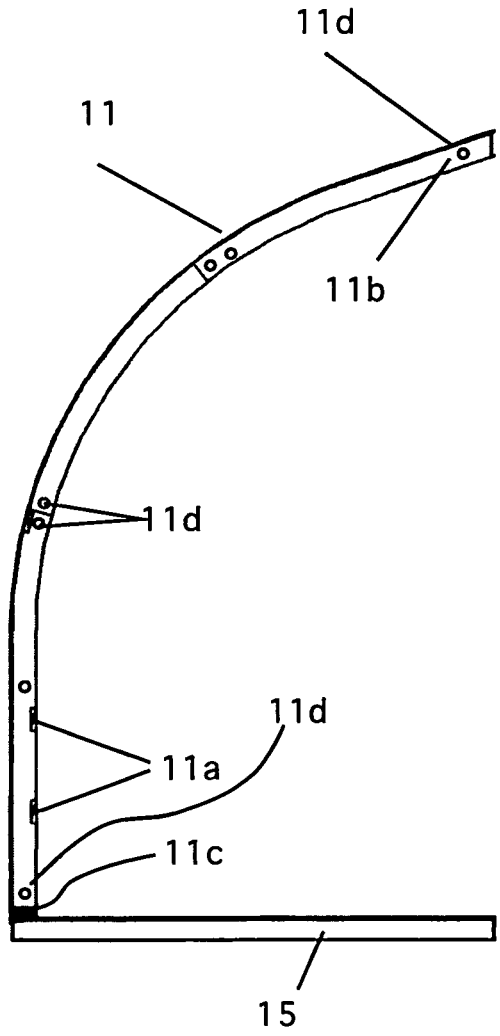
FIG. 4 is a front view of a wall frame member.

FIG. 4 is a front view of one of the arched wall/roof frame members 11, shown in position with relation to the floor 15. In this figure, the wall section 11 has, in the preferred embodiment, a ridge plate 11*b* and the bottom plate 11*c*, which have ¼ inch dados for ribs. Inset pieces (not shown) are glued and stapled. Plates are also glued and stapled. All arched wall panels have let-in bracing 11*a* that doubles as attachment points for beds (standard), counters (standard), and cabinets (optional) as well as providing an excellent hand-hold for lifting. Also, each arched wall panel has a number of holes 11*d* drilled as shown that are used to hold bolts when the wall sections are bolted together, as discussed below. Each wall panel rib is made of ¾ inch type cdx plywood that is cut to 3½ inch width. The arches are cut with CNC machines and include notches 11*a* for interior wall attachments, such as beds and cabinets (not shown). These notches are positioned at 18 inches and 32 inches above the floor in the preferred embodiment.

In the preferred embodiment, each arch wall frame member has a height of 10 feet. The curved radius r is 6 foot 0 inches measured from the center of the floor at a height of 3'-8" above the floor. Wall frame components (ribs, plates and inset pieces) are placed into a jig and fastened together with glue and staples. Then the frame is covered with 5 mm luan underlayment plywood attached with glue and staples. The 'skin' of 0.040" ABS sheeting is applied to the plywood with 3M VHB bonding tape. Then the gaskets at the edges of the wall frames are installed with bonding tape. When assembled, each wall panel consists of a pair of frames and a 4-foot outer skin of the luan and ABS sheeting, as shown in FIGS. 4*a* and 4*b*.

Figure 4A:
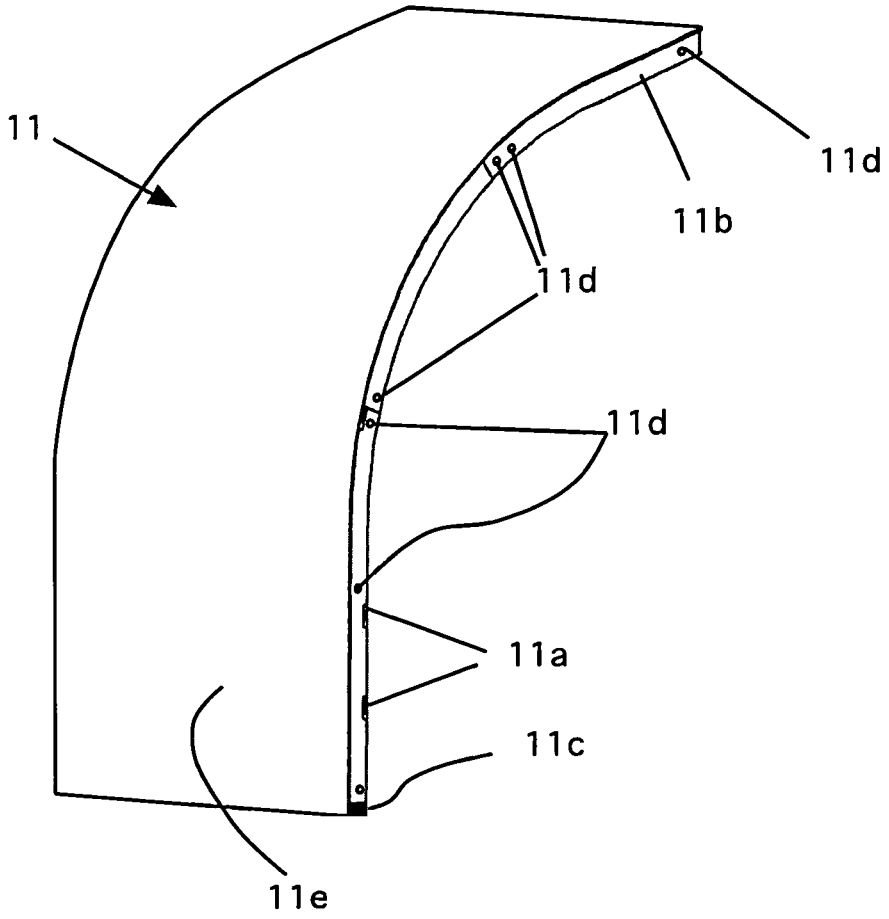
FIG. 4*a* is a perspective view of a wall member.

FIG. 4*a* is a perspective view of one of the arched wall/roof frame members 11. In this view, the front rib is shown along with the wall siding 11*e*. Each arched wall section is four feet wide with two ribs, front and back. The 'skin' of 0.040" ABS sheeting is applied to the luan plywood (see FIG. 9) with 3M VHB bonding tape.

Figure 4B:
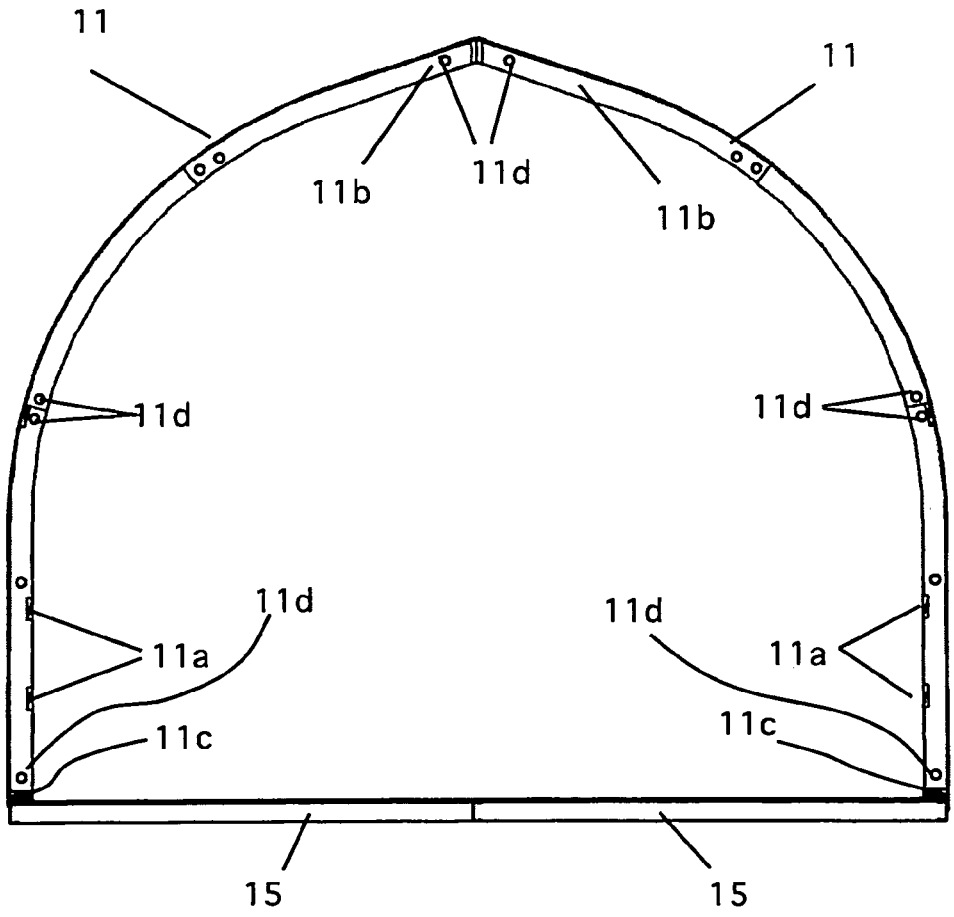
FIG. 4*b* is a front view of a fully assembled wall section.

FIG. 4*b* is a front view of two of the arched wall/roof frame members 11 assembled. This assembly can be called a full wall section. Here, two of the panels are in place and are joined, as discussed below, at the top and at the floor 15.

Figure 9:
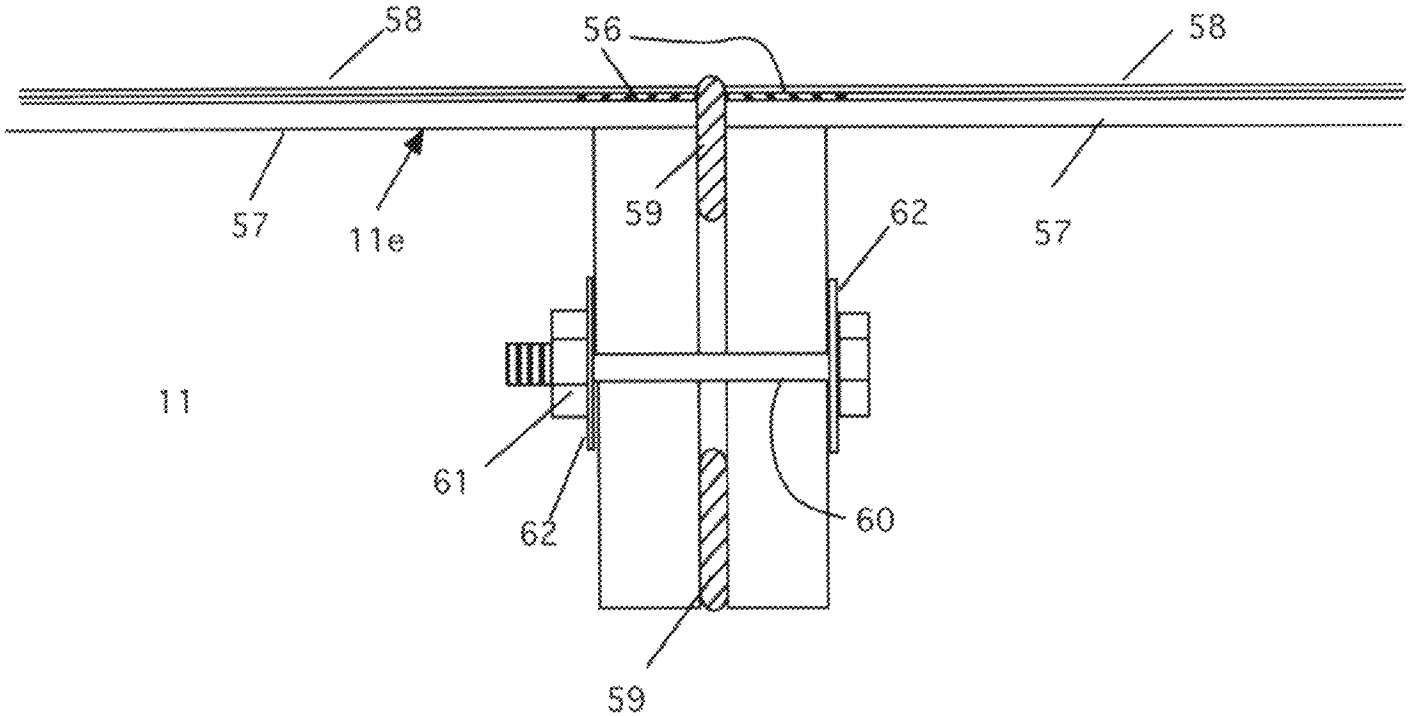
FIG. 9 is a detail of the connection between two wall adjacent frame members, or the roof member joint connections.

Each of the arched combination wall/roof panels 11 weighs less than 100 pounds and is easily handled by two workers. Each panel is placed on the completed 'deck' and the bottom of the panel is slid up to the stop strip on the outside edge. Then the panel is lifted up to vertical and the extendable paint poles are placed inside the ridge plate in two locations to hold the panel in place. This stabilizes the wall/roof panel until the opposite wall/roof panel is raised in the same manner. Then while one worker places a 6' stepladder in the center of the building the second worker gradually lowers the paint poles allowing the two ridge plates 11*b* to contact each other. The workers then align pre-bored holes in the ridge plates and install ¼"bolts (e.g., e.g., FIG. 9) in each hole. Then the worker anchors the bottom plate by screwing it to the floor with supplied screws. This forms a complete wall section. In this way, each pair of panels is raised until all the wall/roof panels are standing. When all wall/roof panels are standing they are bolted together (though pre-bored holes) 11*d* as shown in FIG. 9.

Each wall/roof panel includes one 5,000 pound rated anchor ring bolted through the wall structure (not shown). Using this ring you can attach to a concrete weight, a dead man or a knotted rope frozen in permafrost to keep the shelter from blowing away in high wind areas. The shelter's sloped sides shed wind as effectively as they shed water.

Figure 5:
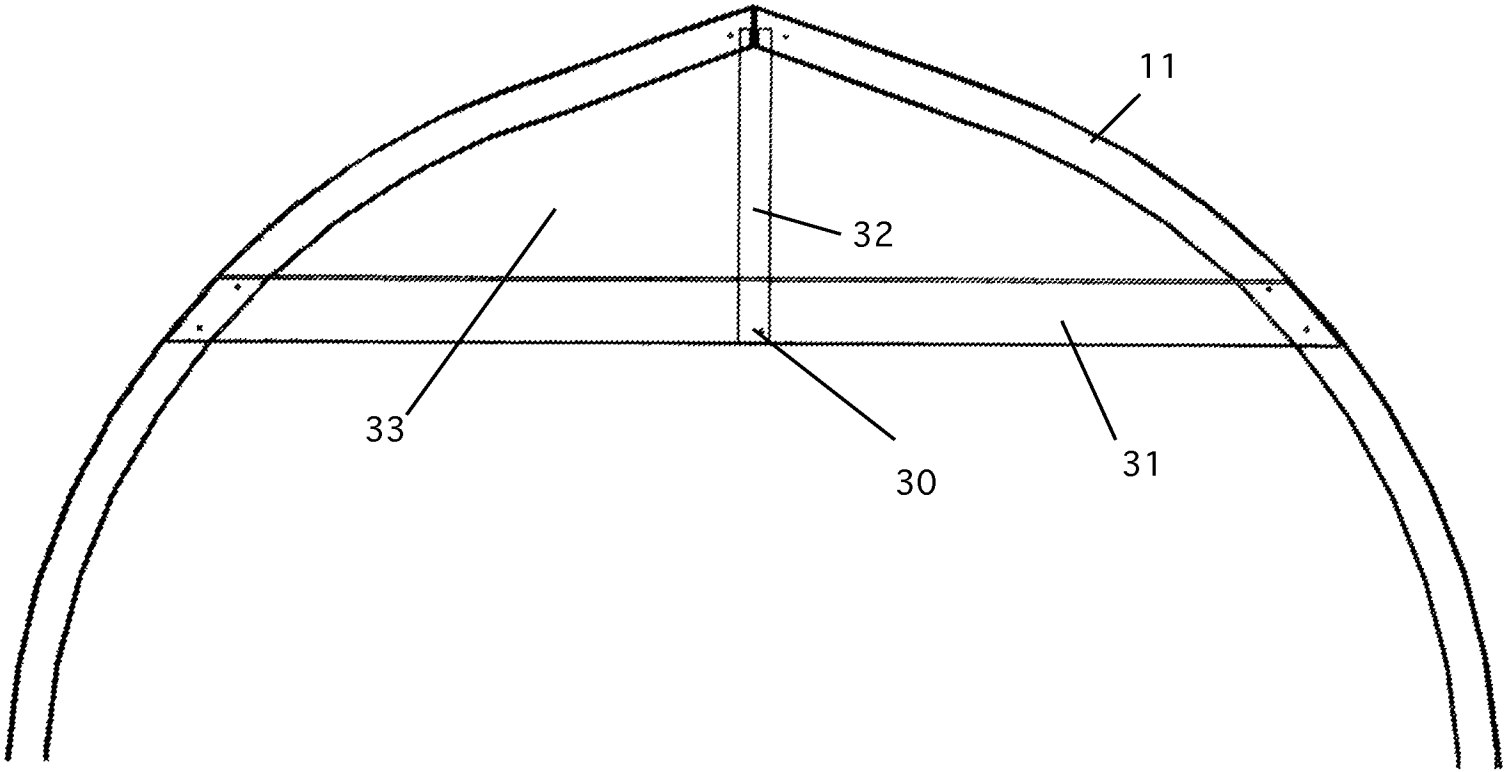
FIG. 5 is a detail view of a roof truss.

FIG. 5 is a detail view of a roof truss 30. A collar-tie and kingpin components are added creating a simple truss. These are shown in FIG. 5. The collar tie 31 is shown connecting to the curved frame members. The "king-pin" vertical member 32 is shown attached to the collar tie and the center of the curved frame top. Note that the area above the truss 33 can be used for storage.

Figure 6:
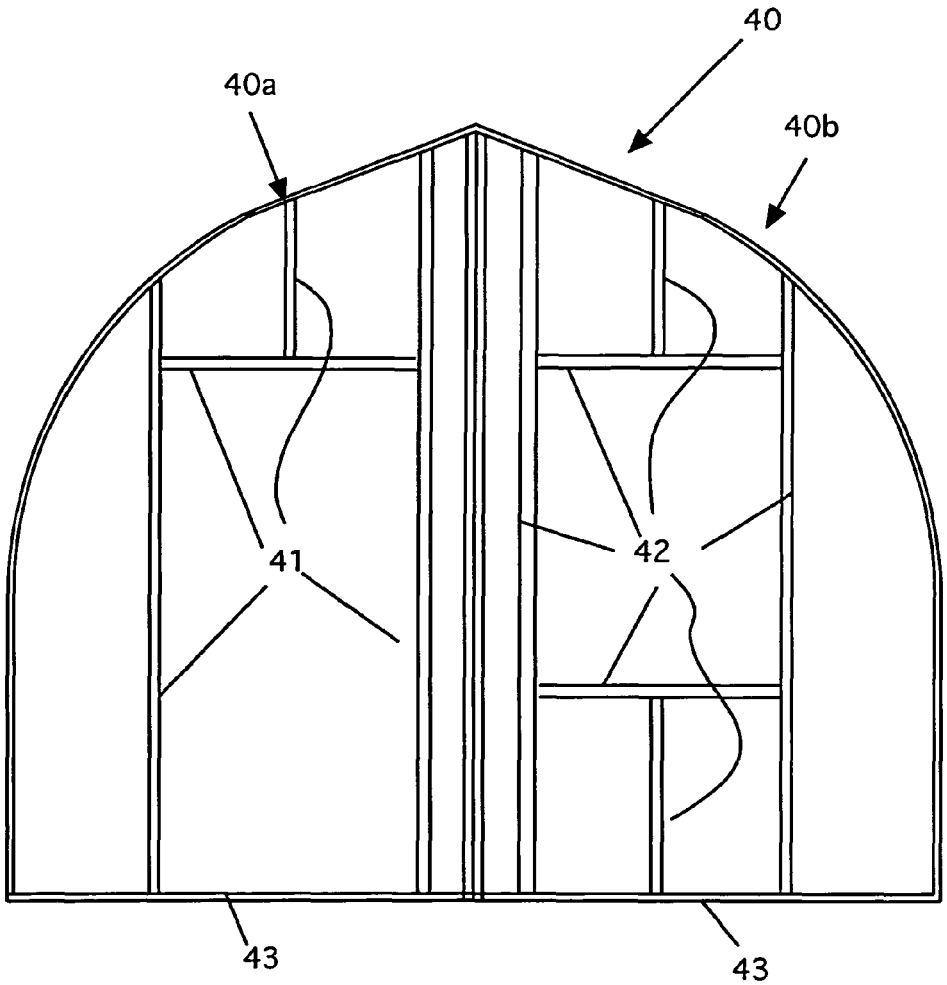
FIG. 6 is a front view of the front gable end frame.

FIG. 6 is a front view of the front gable end frame panels 40. Like the main wall sections, the end wall panels are made up of two pieces 40*a* and 40*b*. Each of the panels 40*a* and 40*b*, in the preferred embodiment, are 5' 8½" wide×9' 8½" tall and contain either a 3'0"×6'8" insulated steel entry door 13 or a 3'2"×4'0" single-hung, vinyl, egress window 14 (see FIG. 1). To accommodate the door and window, framing members 41 are used for the door and members 42 are used for the window, the placement of which uses standard framing techniques known in the art. In the preferred embodiment, these framing members are 1"×4" wood. Again, in the preferred embodiment, the radius of the curve for the gable ends is slightly smaller than that of the curved wall frame members. Here, the radius is 5 feet, 8⅜ inches. As measured from the center of the floor, the curve begins at a height of 3'-8". The gable end arch members are made of ⅜-inch plywood strips that are doubled and laminated to form the arched frame.

Figure 6A:
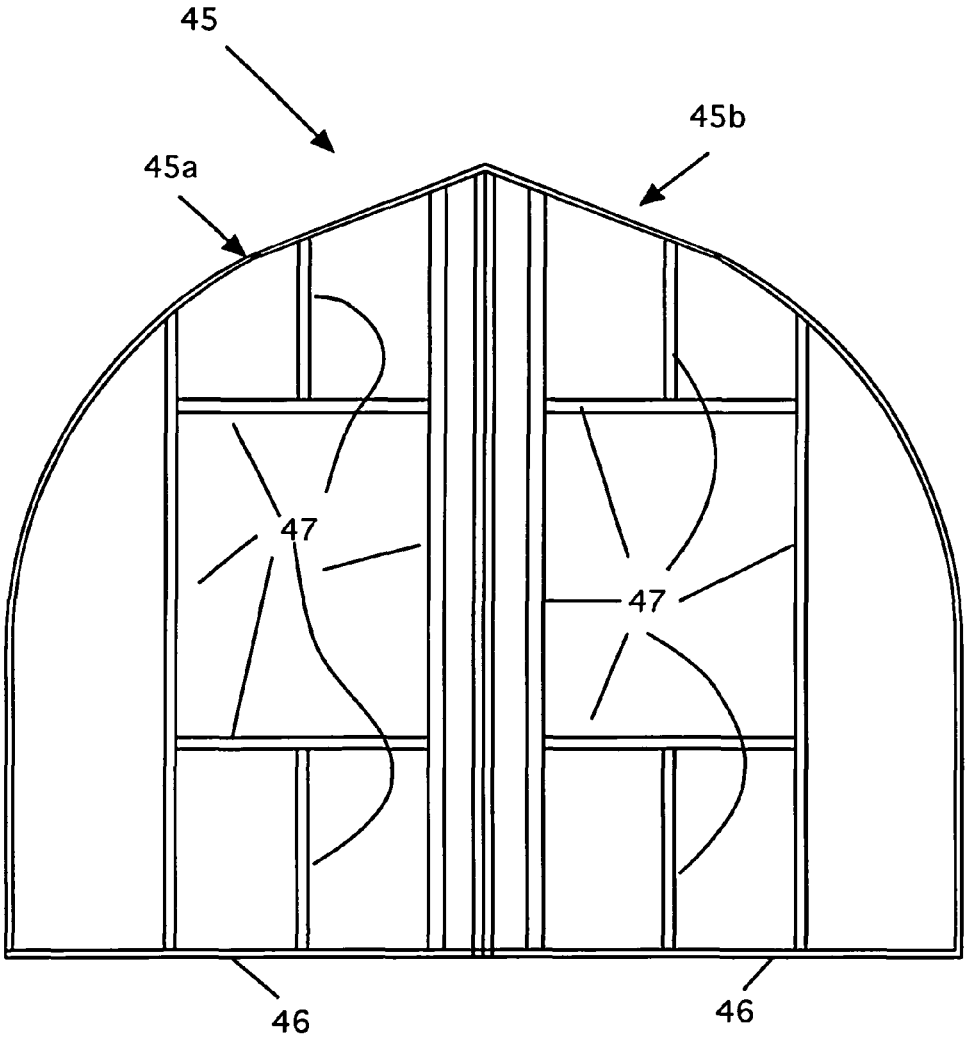
FIG. 6*a* is a front view of the rear gable end frame.

FIG. 6*a* shows the rear gable end frame 45, which has two parts 45*a* and 45*b*. This end has a bottom plate 46 two windows and associated framing 47, instead of a window and door as in the front gable.

Figure 7:
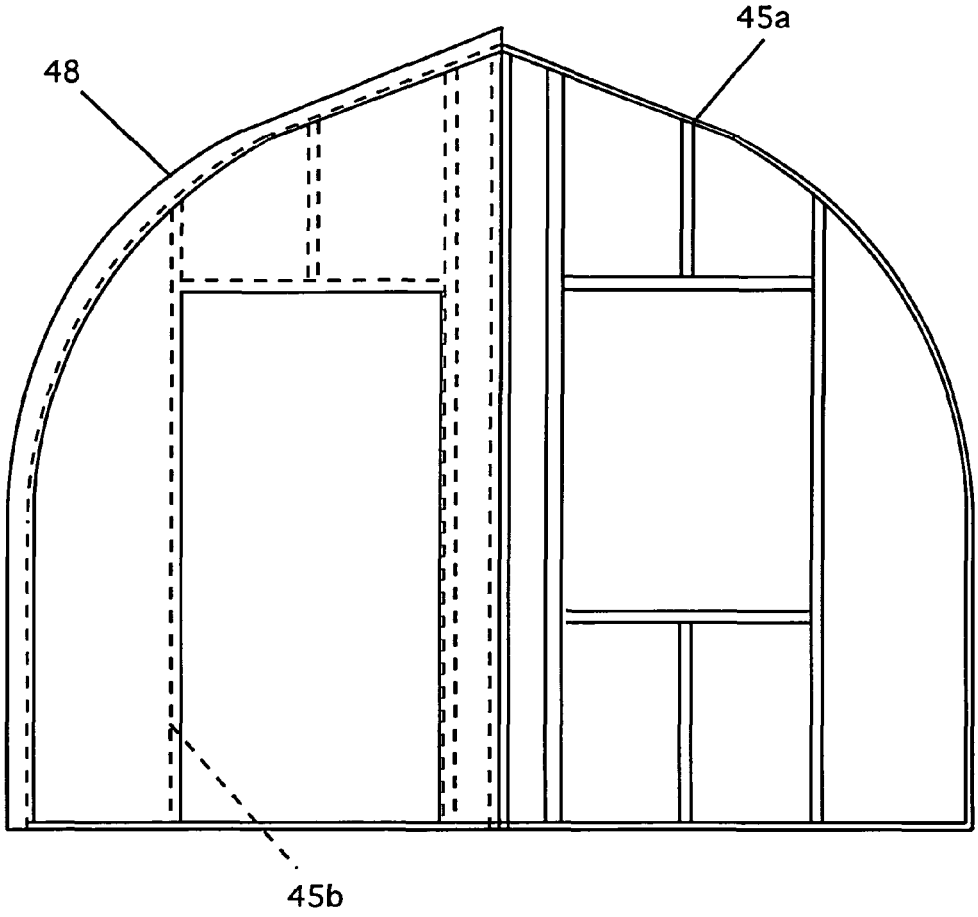
FIG. 7 is a front view of the front gable frame showing the wall sheathing in place on one-half of the frame.

FIG. 7 is a front view of the front gable frame showing the wall sheathing in place on one-half of the frame. The end wall sheathing 48 is preferably ⅜" plywood covered by the 0.040" ABS plastic sheeting (see FIG. 8). Note that the wall sheathing extends past the frame on the side and top. This allows the end frame to set inside the final set of wall ribs and to have the sheathing extend over the end wall ribs to make a tight seal, as discussed below.

The end wall panels are lifted onto the completed floor panel 'deck' at each end after the wall/roof panels have been placed but before they are bolted together. The end wall panel is secured to the floor by screws placed through the bottom plate 43. These anchor the wall to the deck and once bolts are fully placed, they tie the end wall panel to the well/roof panels creating a 'monocoque' shell that is stronger than other construction methods.

Figure 8:
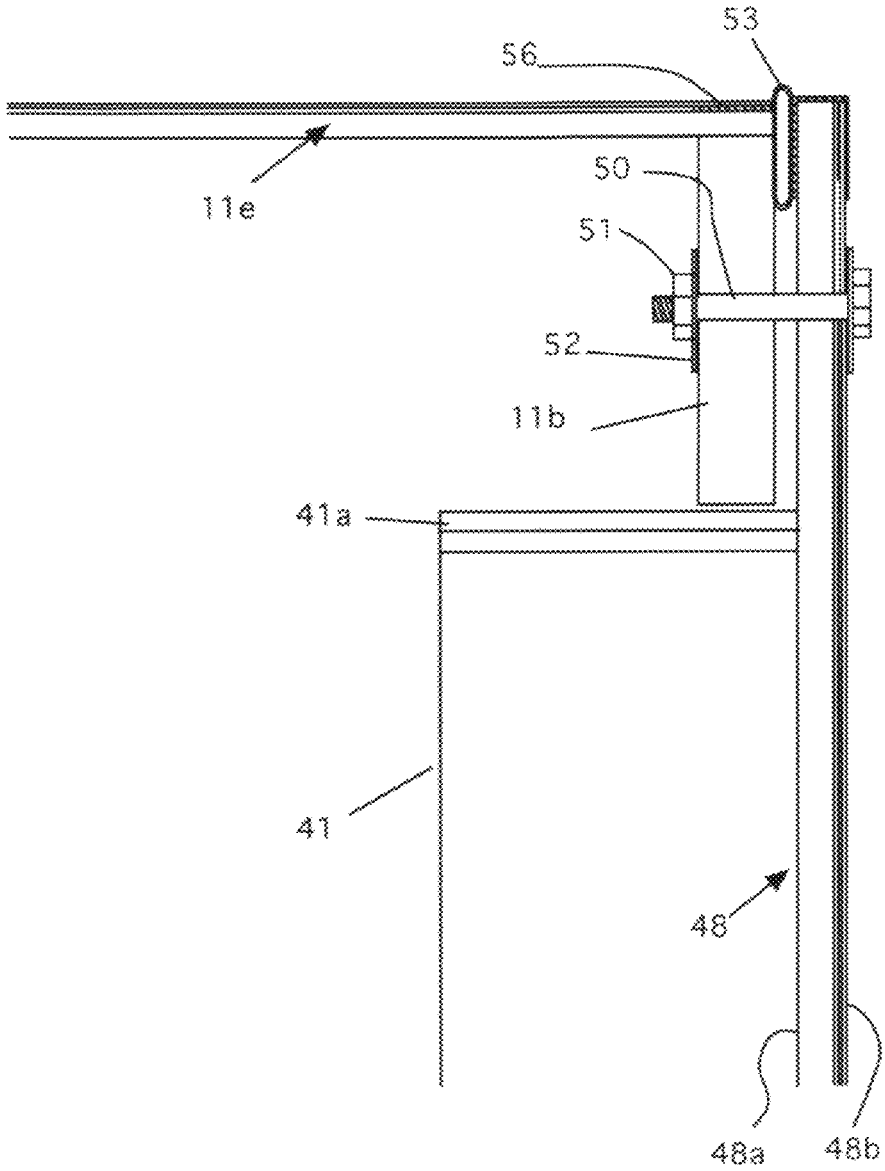
FIG. 8 is a detail view of an end wall panel showing a flange that bolts onto the end wall/roof panel to form a weather-tight seal.

FIG. 8 is a detail view of an end wall panel showing a flange that bolts onto the end wall/roof panel to form a weather-tight seal. The figure shows the wall frame members 41 at the top of the frame. The wall frame has a top plate 41*a*, which, in the preferred embodiment, is made up of two pieces of ⅜" plywood. Attached to the frame 42 is the outer sheathing 48 that consists of an inner piece of ⅜" plywood 48*a* and the 0.040" ABS plastic sheeting 48*b*. Note that the sheathing 48 extends beyond the frame, as noted above. The figure also shows a portion of an arched wall panel 11 showing the sheathing (5 mm luan on the inside and the 0.040 ABS on the outside) 11*e* in cross section. It also shows a ridge plate 11*b*, e.g., that is ¾" cdx plywood, as discussed above. The gable is attached to the wall panel with a ¼" bolt 50 with fender washers 51 and a nut 52. Note that other bolts are used to tie the sheathing of the end wall frame to the wall section, as noted. The joint is sealed with and "edge grip" rubber seal 53 that is placed over the top end of the end wall sheathing and in between the two joining members, as shown. Note, in this view, a portion of the VHB tape 56 is shown that attaches the, 040 ABS to the ⅜-inch plywood. This tape is made by the 3M corporation of Minneapolis, Minn.

As noted above, the two wall sections are secured at the top by a bolted joint. In addition, adjoining wall sections are bolted through at the placed marked 11*d* on FIGS. 4, 4*a* and 4*b*. FIG. 9 is a detail of the connection between two wall adjacent frame members, or the roof member joint connections. FIG. 9 shows a portion of two wall sections-either at the roof junction or any of the side connections. Each wall section 11 has the wall sheathing 11*e* comprising the 5 mm luan 57 and the 0.040 ABS sheeting 58. Note that the VHB tape 56 that attaches the 0.040 ABS to the luan plywood is show on both sides of the joint. A piece of EPDM foam gasket 59 that has adhesive backing on one side is shown in place between the joint. This makes for a tight seal when the wall sections are bolted together. A ¼" bolt 60, nut 61 and washers 62 are used to make the connection. This procedure is repeated at the various bolt points around the frames.

The shelter is shipped on a specially designed pallet that converts to a 6'0"×12'0" cedar deck after all other components have been placed. It is designed to simply lie on the extended floor panel support planks at the front door. It can also be anchored to the floor panel support planks with screws.

Figure 10:
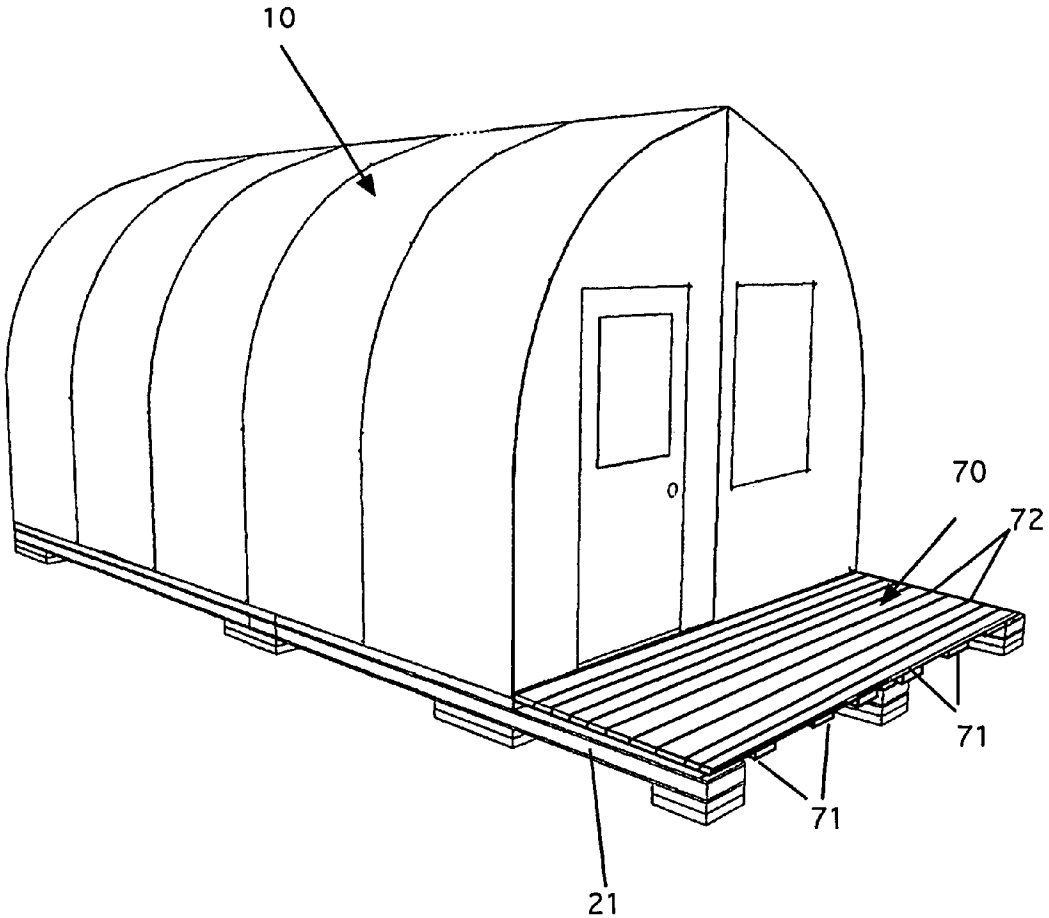
FIG. 10 is a front perspective view of shelter with the optional front deck installed.
Figure 11:
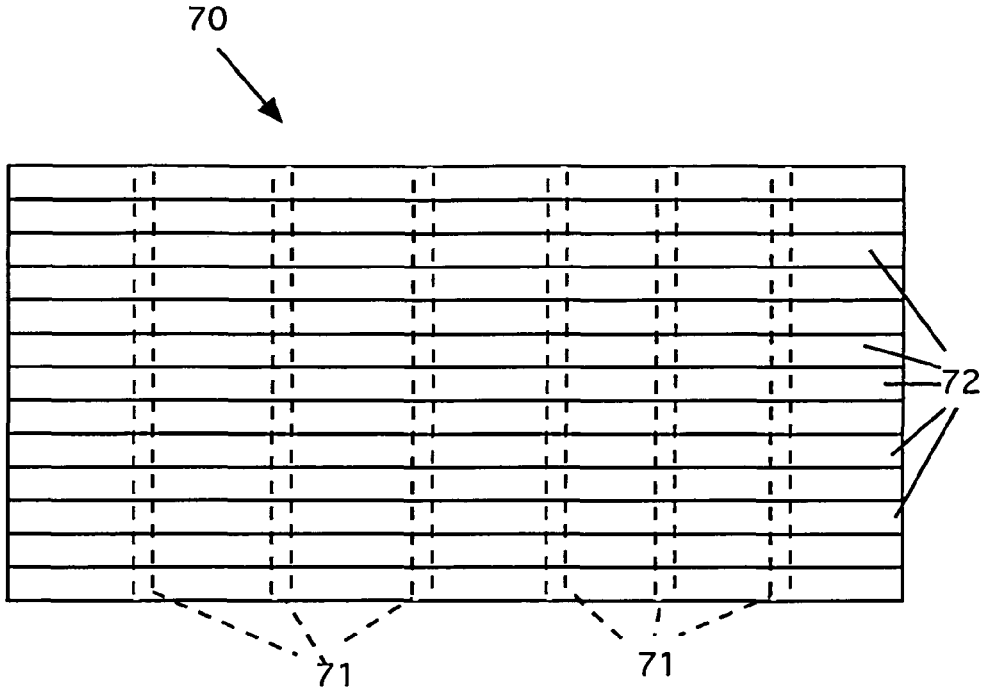
FIG. 11 is a view of the optional front deck.

FIG. 10 shows the shelter 10 with the porch 70 installed. The porch 70 rests on the main foundation timbers 21 as shown. FIG. 11 shows a top view of the deck 70. It is made up of framing members 71 that lie beneath the deck surface 72, which is made up of the pallet material. In the preferred embodiment, the porch is 6 ft wide, by 12 feet long.

A single axle trailer (3,500 pound capacity) with a 10'-12' flat deck will suffice for shipping the shelter to a specific location. For shipping, the shelter is split into two packages so that is can be moved using a 1,500 pound rated snowmobile trailer.

The shelter comes with floor insulation. Wall/roof insulation can be provided either during manufacture or as an after market package consisting of the insulation rolls, spray adhesive and instructions. The layers of insulation installed can adjust R-value.

All wall/roof panels have let-in braces for quick attachment of bed platforms as well as let-in braces for quick attachment of counter/tables (not shown).

Pre-cut vinyl or Astroturf flooring can be provided that is simply rolled out after this shelter is setup. Having the flooring installed this way makes cleaning easy as the flooring can simply be rolled up and taken outside of the shelter to shake it out. The flooring also adds some insulation to the floor as well as protects the wood surface from moisture and damage.

Lighting systems for part and full-time use can be installed as well. All lighting systems will be designed to install after setup. Both battery and renewable energy systems will be available.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

We claim:

1. A modular portable shelter for efficient transport and assembly comprising:

a) a foundation having a plurality of base pads, and at least three support planks, placed upon said plurality of base pads;

b) a floor, placed atop said foundation, said floor having a frame and a top surface;

c) a plurality of arched half-wall assemblies attached to said floor, each of said half-wall assemblies having at least two rib members, each of the at least two rib members having an upper portion and an outer face;

d) an outer sheath, having a top portion, attached to said at least two rib members, wherein the upper portion of said at least two rib members and the top portion of said outer sheath forms a roof structure;

e) further wherein, two of said arched half-wall assemblies, being oppositely disposed, form an arched full-wall section, wherein said shelter comprises a plurality of said full-wall sections;

f) a first gasket attached to one of said at least two rib members such that the first gasket is positioned on said outer face of one of said rib members;

g) a second gasket attached to the other of said at least two rib members such that the second gasket is positioned on said outer face of the other of said rib members;

h) a front gable panel, attached to said floor and to one of said arched full-wall sections;

i) a rear gable panel being attached to said floor and to another one of said arched full-wall sections;

j) wherein, when a second one of said half-wall assemblies is attached to said floor, the second gasket on a first one of said half-wall assemblies contacts the first gasket on said second one of said half-wall assemblies, thereby forming a seal between said first one of said half-wall assemblies and said second one of said half-wall assemblies;

k) each of said rib members includes a roof joint bolt flange; and l) wherein a first one of said roof joint bolt flanges is connected to a second, oppositely disposed one of said roof joint bolt flanges.

2. The shelter of claim 1 wherein the plurality of base pads comprise: a plurality of foam pier pads each of said foam pier pads being made of high-density foam.

3. The shelter of claim 2 wherein said base pads comprise end pads and junction pads, and further wherein the end pads are three pads being 2 feet long by 1 foot wide and the junction pads are three pads being 1 foot long and one foot wide.

4. The shelter of claim 1 wherein each of the support planks comprise a metal stud and track, having a top, a bottom and an outside surface; and further wherein said metal stud and track has a ⅜" plywood layer attached to the top, bottom and outside surface of said metal stud and track.

5. The shelter of claim 1 wherein the outer sheath on each of said plurality of arched half-wall assemblies comprises:

a) a piece of luan plywood; and b) a covering of ABS sheeting, secured to said piece of luan plywood.

6. The shelter of claim 5 wherein the ABS sheeting has a thickness of about 0.040 inches.

7. The shelter of claim 6 wherein said piece of luan plywood is about 5 mm thick.

8. The shelter of claim 7 wherein each of said arched half-wall assemblies weighs about 100 pounds.

9. The shelter of claim 1 wherein each of said rib members in said arched half-wall assemblies has a plurality of bolt holes formed therein.

10. The shelter of claim 1 wherein said foundation further comprises a deck, installed on said foundation.

11. The shelter of claim 1 wherein the front end gable includes a door and a window.

12. The shelter of claim 1 wherein each of said rib members further comprise receivers, formed in said rib members for receiving and supporting furnishings.

* * * * *